US007746188B2

(12) United States Patent
Pietig et al.

(10) Patent No.: US 7,746,188 B2
(45) Date of Patent: Jun. 29, 2010

(54) INTEGRATED NON-RECIPROCAL COMPONENT

(75) Inventors: Rainer Pietig, Herzogenrath (DE); Meng Cao, Xi'An (CN)

(73) Assignee: ST-Ericsson SA, Plan-les-Ouates (CH)

( * ) Notice: Subject to any disclaimer, the term of this patent is extended or adjusted under 35 U.S.C. 154(b) by 0 days.

(21) Appl. No.: 11/658,230

(22) PCT Filed: Jul. 13, 2005

(86) PCT No.: PCT/IB2005/052322

§ 371 (c)(1),
(2), (4) Date: Nov. 24, 2008

(87) PCT Pub. No.: WO2006/011089

PCT Pub. Date: Feb. 2, 2006

(65) Prior Publication Data

US 2009/0072922 A1 Mar. 19, 2009

(30) Foreign Application Priority Data

Jul. 22, 2004 (EP) ..... 04300458

(51) Int. Cl.
*H01P 1/32* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS 5,638,033 A 6/1997 Walker et al.

(Continued)

FOREIGN PATENT DOCUMENTS

JP 06 252613 9/1994

(Continued)

OTHER PUBLICATIONS

Michalski J et al: "Scattering in a Section of Ferrite-Coupled Microstrip . . . " IEEE Proceedings: Microwaves, Antennas and Propagation Stevenage, Herts, GB vol. 149 No. 56; Mar. 20, 2001; pp. 286-290.

(Continued)

*Primary Examiner*—Stephen E Jones
(74) *Attorney, Agent, or Firm*—Robert Iannucci; Seed IP Law Group PLLC

(57) ABSTRACT

The invention relates to a non-reciprocal component comprising a first dielectric part (11) and a ferrite substrate (12) located on the same level, a ground layer (18) is located below the ferrite substrate (12), a metal line arrangement (14) is located on the level having the first dielectric part (11) and the ferrite substrate (12), wherein the metal line arrangement (14) comprises a first and a second metal line (15, 16) arranged in parallel to each on the ferrite substrate (12), the first metal line (15) provides a first port (P1) and the second metal line (16) provides a second port (P2), wherein the first and second metal lines (15, 16) are connected in a portion between the first dielectric part (11) and the ferrite substrate (12) forming a single third metal line (17), which ends with third port (P3), wherein the ferrite substrate (11) is magnetized in parallel to the metal lines (15, 16) and at least one matching network (19, 20) is assigned to at least one of the ports (P1, P2). By coupling the matching networks (19, 20) to the first and second port (P1) and (P2) a substantially reduction of length of the metal line arrangement is achieved. This reduction allows an integration of the non-reciprocal component (10).

20 Claims, 3 Drawing Sheets

U.S. PATENT DOCUMENTS 6,850,751 B1 2/2005 Shiiba et al.

FOREIGN PATENT DOCUMENTS

JP 06-252613 A 9/1994
JP 08-023212 A 1/1996
JP 08-125411 5/1996

OTHER PUBLICATIONS

Mazur et al., "Coupled-Mode Design of Ferrite-Loaded Coupled-Microstrip-Lines Section," IEEE Transactions on Microwave Theory and Techniques 50(6):1487-1494, Jun. 2002.

INTEGRATED NON-RECIPROCAL COMPONENT

The invention relates to a non-reciprocal component comprising a first dielectric part, a ferrite substrate located on the same level, a metal line arrangement is located on the level having the first dielectric part and the ferrite substrate. The invention further relates to an integrated circuit having a non-reciprocal component and to a circulator.

Non-reciprocal components are used especially in microwave technology, which has become very important during the last years. Various frequency bands are used for commercial applications e.g. GSM (~1 GHz), UMTS (~2 GHz), Bluetooth (~2.5 GHz), WLAN (~5 GHz) etc. There is a clear trend towards higher frequencies in order to obtain larger bandwidths and hence higher data rates. Moreover new microwave applications at higher frequencies like car radar (24 GHz or 77 GHz) have entered the market. In this sector, a large growth within the next few years is expected.

Prominent examples of non-reciprocal components are circulators and isolators. Non-reciprocal components are used in the area of high frequency transmission if a signal in the high frequency range, in particular in the microwave range, should be guided only in one direction without a loss while inhibiting transmission of signals in the opposing direction. E.g. isolators are used in an RF front end of UMTS phones, since the required linearity of the transceiver can be guaranteed in a simple way by using such an isolator. In that case the isolator is connected between the antenna of a mobile terminal and the output power amplifier. The signal coming from the output power amplifier is coupled into the isolator in port 1 and outputted at port 2 and directed to the antenna. The isolator insulates the power amplifier from a signal running back from the antenna to the power amplifier.

Circulators and isolators have a wide range of application. In many cases simple and robust system architectures can be provided using such non-reciprocal components. The application of non-reciprocal components simplifies the design process of high frequency parts and saves cost. The high cost of the non-reciprocal components are accepted, since a modified system architecture without the need of a non-reciprocal component would be very difficult to design and not reliable.

State of the art non-reciprocal components have high production costs due to their very complex internal set up. To generate the non-reciprocal effect, ferrite material is essentially needed. Apart from a ferrite material various metal electrodes or metallization layers are required to guide the microwave, wherein the microwave is guided between metallization layers. One or two permanent magnets are needed to magnetize the ferrite material. Moreover several pole pieces are needed to guide the magnetic field lines of the permanent magnet in order to generate a very homogeneous magnetic field in the region of the ferrite material. All parts of the non-reciprocal component have to be assembled during a complicated production process.

The DE 100 11 174 A1 describes a circulator/isolator using lumped elements and a magnetization perpendicular to the propagation of the microwave. The figures illustrate the complex configuration and the required height.

The integration of passive components like capacitors and inductors either into a substrate by using multilayer LTCC or multilayer laminates, etc. or directly on a semiconductor chip has become an industrial standard in order to miniaturize and reduce the costs of electronic circuits. Due to their height there are no integrated solutions for non-reciprocal components.

Since the design known from the prior art of non-reciprocal components uses a magnetic field directed perpendicular to the propagation direction of the microwave it was not possible to integrate such non-reciprocal components. The permanent magnets for generating the magnetic field have to be placed below and/or above the ferrite material. This results into a large height of the component. Since the required permanent magnetic field increases with the working frequency, the height problems become particularly severe in the high frequency range. Moreover, the configuration using a perpendicular magnetic field leads to large demagnetization effects, which can be compensated only by using stronger and therefore bigger permanent magnets. At high working frequencies, this problem becomes more and more pronounced. Integration of such a design is therefore not feasible.

An alternative with respect to integration of passive components could be a magnetization of the ferrite substrate in the direction parallel or in-plane to the ferrite substrate. This means the magnetic field lines are directed in propagation direction of the microwave. The simplest design of this in-plane magnetization of the ferrite substrate may include two parallel metal lines, which are printed on a ferrite substrate. To achieve an acceptable non-reciprocal behavior of the components using in-plane magnetization of the ferrite substrate the required lengths of the metal lines are quite large. The required length of the metal lines will reduce the commercial value of the design.

Therefore it is an object of the present invention to provide a non-reciprocal component having reasonable dimensions allowing an integration of non-reciprocal components.

The object of the present invention is solved by the features given in the independent claims.

The invention is based on the thought that by using in-plane magnetization of a ferrite substrate the height problem mentioned above will be solved. However the only use of in-plane magnetization would not produce components having lengths which could be integrated. Therefore it is proposed to arrange a ferrite substrate and a first dielectric part on a ground layer. A metal line arrangement is printed on the ferrite substrate and a first dielectric part. The metal line arrangement comprises a first and a second metal line arranged in parallel on the ferrite substrate, the first metal line provides a first port and the second metal line provides a second port. The first and second metal lines are connected on the first dielectric part in a portion adjacent to the ferrite substrate. On the first dielectric part the metal line arrangement is provided as a single third metal line, which ends with a third port. The ferrite substrate is magnetized in parallel to the metal lines. Both the first and second metal lines of the metal line arrangement are connected with a matching network. By using appropriate matching networks at least at the first port and second port, the length of the required metal arrangement and thus of the whole non-reciprocal component will be reduced substantially.

The working principle of the non-reciprocal component without a matching network is based on the non-reciprocal interaction of the microwave with the magnetized ferrite material. The total effect on the microwave is roughly proportional to the length of the coupled lines on the ferrite. The non-reciprocal effect accumulates like a phase, while the microwave travels through the device. To guarantee proper circulation or non reciprocal behaviour, the total accumulated non-reciprocal phase and therefore the length of the device has to have a certain fixed value. The matching networks force the wave to effectively pass the coupled metal lines on the ferrite several times by multiple reflections. The physical length of the device can therefore be reduced if appropriate matching networks are attached at the ports.

In a preferred embodiment there is a second dielectric part provided. The second dielectric part is located on the same level as the first dielectric part and the ferrite substrate. Below the first and second dielectric parts and the ferrite substrate the ground layer is located for guiding the microwave between the metal line arrangement and the ground layer. The ferrite substrate is located between the first and second dielectric part in longitudinal extension of the non reciprocal component. Further a first matching network is coupled to the first port and located on the second dielectric part. A second matching network is coupled to the second port and also located on the second dielectric part. The first matching network is a metal line connected to the first metal line and the second matching network is a metal line connected to the second metal line. By respective coupling the first and second matching networks to the first and second metal lines a reduction of length of the metal line arrangement could be achieved.

A non-reciprocal component having an optimal length has a relative broad frequency range. However this broad frequency range is not always needed for each application. By coupling a first and second matching network to the first and second port a limitation of a frequency range will appear. However the limitation can be easily accepted, since the resulting frequency range after coupling the matching networks is sufficient for many applications like e.g. car radar. By using a non-reciprocal component within a certain application area the frequency range is defined so the required frequency range of the non-reciprocal component could be adapted.

By designing the first and second matching networks as metal lines coupled to the first and second metal lines of the metal line arrangement the non-reciprocal component will have a reduced length without the height problem of conventional non-reciprocal components. Such non-reciprocal component having a reduced length and a very small height can be easily integrated.

A further third matching network is coupled to the third port and arranged on the first dielectric part. The third matching network will also improve the impedance adjustment and support the integration of the non-reciprocal component. In particular the third matching network is realized as serial connection of metal lines having decreasing widths, also called stepped impedance transformer. Thus the arrangement of three matching networks within the non-reciprocal component, especially on the level having the first and the second dielectric part and the ferrite substrate in between, will reduce the length dimension of the component and improve the possibility to integrate the component. By a suitable choice of the matching networks, it is possible to reduce the length of the first and second metal lines. In doing so, the bandwidth of the non-reciprocal component is reduced. However, at a required bandwidth of 5% a reduction of the length by a factor of three is possible.

In an alternative embodiment one of the matching networks is realized outside the component using discrete components or lumped elements. This will shorten the dimension of the component.

In a further embodiment a hard ferrite substrate is arranged below the ground layer. The hard ferrite substrate will provide the required magnetic field to magnetize the ferrite substrate above the ground layer. Since demagnetization effects are very small by using in-plane magnetization the remnant magnetization provided by the hard ferrite layer will be sufficient to magnetize the ferrite substrate. The hard ferrite substrate is magnetized once with a predetermined field strength, wherein magnet poles of the hard ferrite substrate are located on a first side and the second side of the hard ferrite substrate. This will cause the magnetic field lines running in parallel to the metal lines within the ferrite substrate.

According to a preferred embodiment the metal lines could be realized as microstrip lines having a dielectric air layer over the metal lines. Alternatively the metal lines could be realized also as striplines having a ground layer below and above the striplines, wherein between the striplines and the upper ground layer a dielectric layer may be provided. The configuration depends on the application and the used integration process. If the non-reciprocal component is used in a LTCC component the striplines will be covered by a dielectric layer which is covered by a ground layer. If the non-reciprocal component is used in an integrated circuit microstrip lines could be used, so the metal lines are covered by an air layer.

The object of the present invention is also solved by an integrated circuit including a non-reciprocal component as described above.

The object of the present invention is also solved by a circulator realized as non-reciprocal component as described above.

Preferred embodiments of the invention are described in detail below, by way of example only, with reference to the following schematic drawings.

FIG. 1 illustrates a top view of a non-reciprocal component according to the present invention;

FIG. 2*a* shows a sectional view of a non-reciprocal component according to the present invention;

FIG. 2*b* shows a sectional view of an alternative non-reciprocal component according to the present invention;

The drawings are provided for illustrative purpose only and do not necessarily represent practical examples of the present invention to scale.

In the following the various exemplary embodiments of the invention are described. Although the present invention is applicable in a broad variety of applications it will be described with the focus put on a 3-port circulator used in the area of microwave technology. A further field for applying the invention might be the use as isolator.

Figure 1:
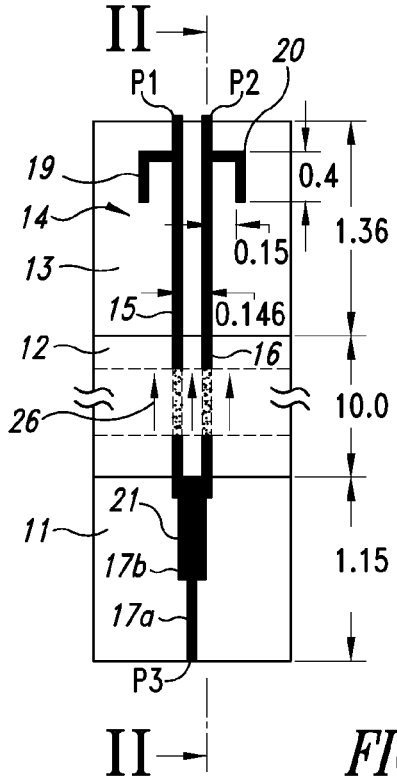

FIG. 1 represents a top view of an embodiment according the present invention. In particular FIG. 1 shows a 3-port circulator. The non-reciprocal component 10 comprises a first dielectric part 11, a ferrite substrate 12 and a second dielectric part 13. The first dielectric part 11, the ferrite substrate 12 and the second dielectric part 13 are located on the same level. On this level a metal line arrangement 14 is located. Below the first dielectric part 11, the ferrite substrate 12 and the second dielectric part 13 a ground layer 18 is arranged. The metal line arrangement 14 comprises a first and a second metal line 15, 16, which are arranged in parallel to each other in a portion of the second dielectric part 13 and the ferrite substrate 12. The first metal line 15 forms a first port P1 at the edge of the second dielectric part 13. The second metal line 16 forms a second port P2 at the edge of the second dielectric part 13. The first and second metal lines 15, 16 are connected on the first dielectric part 11 forming a single third metal line 17. The single third metal line 17 ends with a third port P3 at the edge of the first dielectric part 11. The metal lines 15, 16 and 17 are printed on the ferrite substrate 12 and the first and second dielectric part 11 and 13. The ferrite substrate 11 is magnetized in parallel to the metal lines 15, 16 illustrated by magnetic field lines 26.

A first matching network 19 is coupled to the first metal line 15. A second matching network 20 is coupled to the second metal line 16. The first matching network 19 and the second matching network 20 are both arranged on the second dielectric part 13. The first matching network 19 is a metal line connected to the first metal line 15 and the second matching network 20 is a metal line connected to the second metal line 16. The third matching network 21 is coupled to the third metal line 17. The third matching network 21 is arranged on the first dielectric part 11, wherein the third matching network 21 is a serial connection of metal lines 17*a*, 17*b* having decreasing widths. The first and second metal lines 15, 16 are connected by using a T-junction between the first dielectric part 11 and the ferrite substrate 12, in particular on the first dielectric part 11.

FIG. 1 illustrates exemplary dimensions of the non-reciprocal component 10. The measures in the picture are given in mm. As can be seen the portion of the ferrite substrate 12 provides the longest part having a length about 10 mm. The first and the second dielectric parts 11 and 13 are substantial shorter having lengths of 1.15 mm or 1.36 mm. The width of the non-reciprocal component is not shown however a dimension of 1 mm is realistic. The width of the metal line is about 0.028 mm.

Figure 2A:
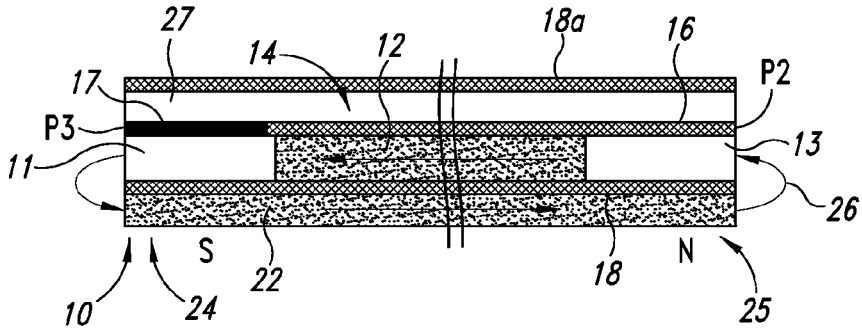

FIG. 2*a* represents a section view along section lines II in FIG. 1, wherein the both upper layers are not illustrated in FIG. 1. In the shown embodiment the metal lines 15, 16 and 17 are realized as striplines. The ferrite substrate 12 is magnetized along arrows 26 in FIG. 2*a*. There is a metal ground layer 18 below the ferrite substrate 12. The first dielectric part 11 and the second dielectric part 13 comprise dielectric material, e.g. ceramic material. The striplines 15, 16 and 17 are covered by a dielectric layer 27. Above the dielectric layer 27 a further ground layer 18*a* is located. This embodiment includes also a hard ferrite substrate 22 located below the ground layer 18. The hard ferrite substrate 22 located below the ground layer 18 is magnetized once. The used material for the hard ferrite substrate could be Barium-Hexaferrite. Since the soft ferrite substrate 12 has a saturation magnetization of 3000 Gauss, the magnetic field for generating this maximal magnetization is provided by the hard ferrite substrate 22. Due to the in-plane magnetization the demagnetizing effects are very small so the required magnetic field needs to be small only, e.g. a few mT. By using a hard ferrite substrate 22 having a S magnetic pole arranged on a first side 24 of the hard ferrite substrate 22 and a N magnetic pole arranged on a second side 25 of the hard ferrite substrate 22 the magnetic field lines 26 will run in parallel to the propagation of a microwave between the striplines 15, 16, and 17 and the ground layer 18. Striplines are used if the non-reciprocal component 10 is incorporated or integrated in a multilayer LTCC component.

Figure 2B:
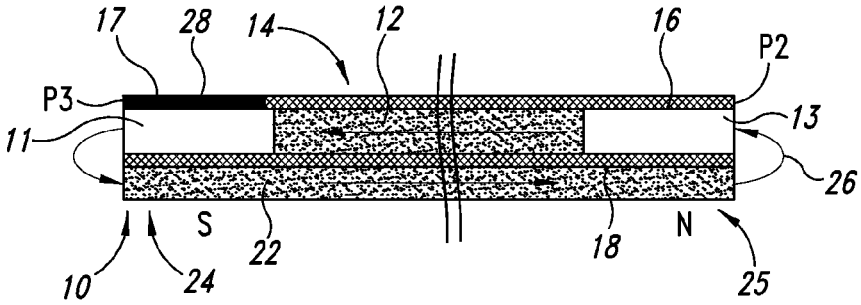

FIG. 2*b* shows an alternative embodiment using microstrip lines. Microstrip lines provide a strong non-reciprocal coupling resulting in short length of the microstrip lines. Microstrip lines 15, 16 and 17 are used if an air layer 28 could be provided above the microstrip lines. The air layer 28 above the microstrip lines has also a dielectric property. Such microstrip lines are used if an integrated circuit or printed circuit boards are used.

The non-reciprocal component using striplines according FIG. 2*a* provides a higher bandwidth than a corresponding non-reciprocal component using microstrip lines according FIG. 2*b*, however the microstrip non-reciprocal component has higher radiation losses.

Figure 3:
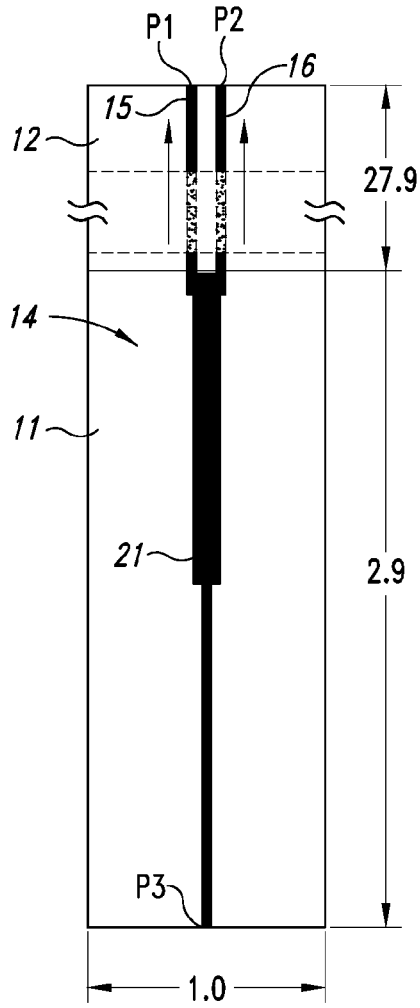
FIG. 3 illustrates a non-reciprocal component without matching networks.

FIG. 3 represents a non-reciprocal component without using of matching networks. The dimensions are substantially higher as can be seen by the illustrated measures. The ferrite substrate 12 has a length of about 27.9 mm, which is nearly three times longer than the ferrite substrate shown in FIG. 1. A non-reciprocal component having such dimensions of nearly 30 mm is hard to integrate. The third port P3 in FIG. 3 is coupled to a third matching network due to the parallel coupling of the first and second metal line at the T-junction. The parallel coupling requires an adaptation of the impedance value of port P3 to be the same as port P1 and port P2.

The reduction in length of the metal lines 15, 16 in FIG. 1 is achieved by the additional matching networks 19 and 20 at port P1 and port P2. The matching networks 19 and 20 are located on the second dielectric part 13. The matching networks 19 and 20 are provided as metal lines having a predetermined length and distance to the first and second metal line. They can also be realized with lumped elements (not shown). With a ferrite substrate thickness of 0.1 mm, a magnetization of 3000 Gauss and a relative permittivity of the material $\in_r$=12, the scattering parameter shown in FIG. 4 are obtained, wherein the 3-port circulator 10 is designed for 24 GHz working frequency.

Figure 4:
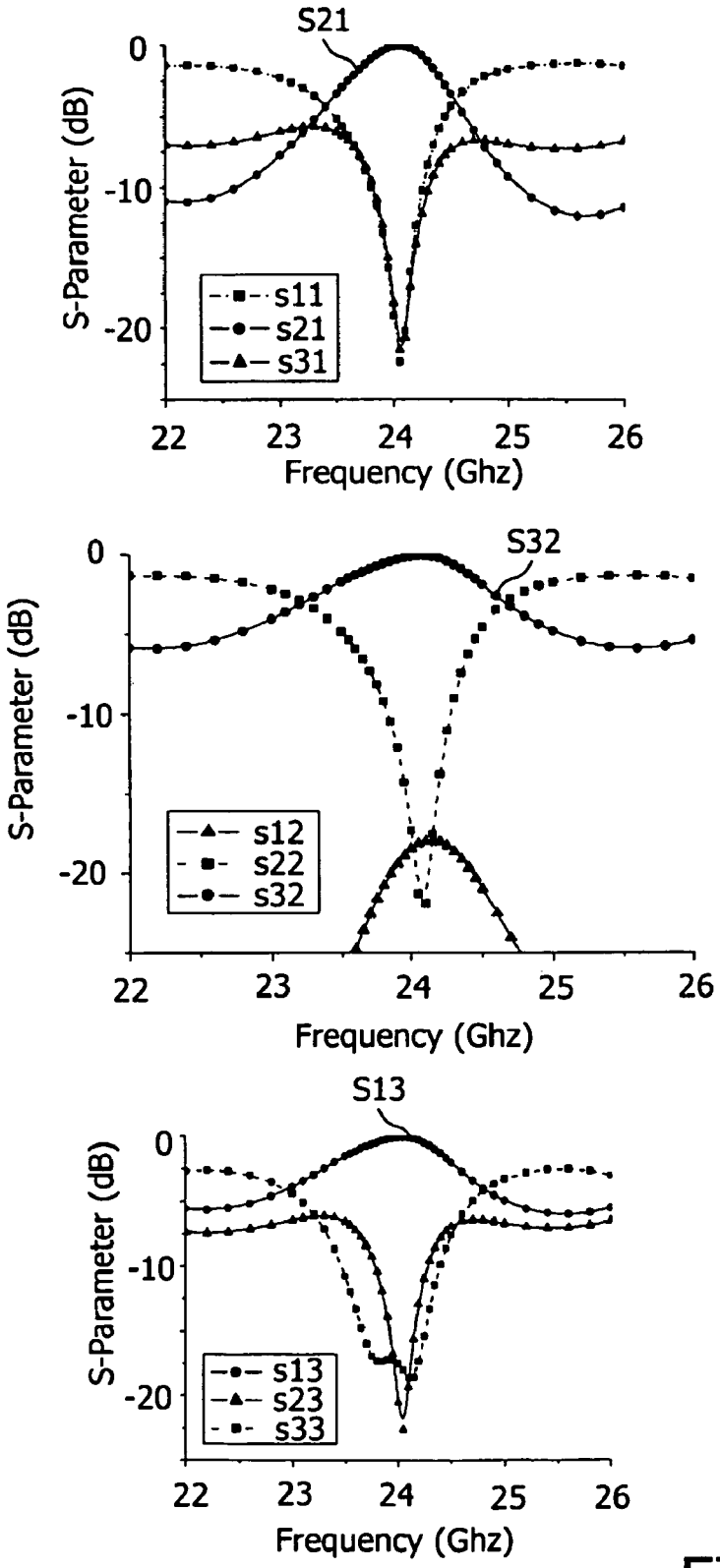
FIG. 4 illustrates scattering parameters of a 3-port circulator according to the present invention.

FIG. 4 illustrates the scattering parameters S21, S32 and S13 for 50 Ohm. As can be seen the direction from port P1 to port P2 is unaffected or not damped in the area of 24 GHz. Also the direction from port P2 to port P3 is unaffected. The direction from port P3 to port P1 is also unaffected. All other directions are damped. So the non-reciprocal component has the required features of a circulator.

Figure 5:
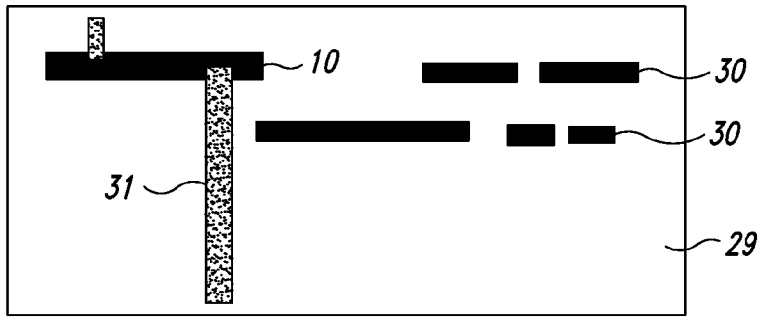
FIG. 5 shows a schematic illustration of integration of a non-reciprocal component into a LTCC component.

Thus a non-reciprocal component will be provided having very small dimensions. The small dimensions allow an integration of the non-reciprocal component 10, e.g. within an LTCC component 29 as shown in FIG. 5. There are further passive components 30 and vias 31 or connectors to connect the respective terminals of the incorporated components 10, 30.

In the following some theoretical considerations are made. The double metal lines 15 and 16 support two TEM modes, which are degenerate if ordinary dielectric material rather than ferrite material is used, i.e. they would propagate with the same speed. The characteristic impedances of the two modes are denoted with Ze and Zo. Due to the magnetized ferrite material 12 this degeneracy is lifted. In this case, the two modes propagate with different speed. The corresponding propagation constants of the modes are denoted with $\beta 1$ and $\beta 2$, they are only depended on the waveguide and are independent on matching networks. These propagation constants are affected by the used ferrite material. The ferrite substrate is realized as soft ferrite substrate using spinel substances or YIG (Yttrium Iron Garnet).

The required length L of the metal lines 15, 16 without additional matching networks 19, 20 is given by $L=\pi/2/|\beta 1-\beta 2|$ (FIG. 3).

Since the first and the second metal line 15, 16 ends are connected parallel at port P3 with a T-junction, the third matching network 21 at port P3 is required to transform the port impedance of port P3 to that of port P1 and port P2.

If the length of the first and the second metal lines 15, 16 is reduced, additional matching networks 19, 20 at port P1 and port P2 are required as shown in FIG. 1. The input impedances Z1, Z2 and Z3 at the ports P1, P2 and P3 without matching networks 19, 20 and 21 are approximately given by $$Z_1 = \sqrt{Z_e Z_o}\,\frac{\sqrt{Z_e}\tan(\phi_-) - j\sqrt{Z_o}\tan(\phi_+)}{\sqrt{Z_e} - j\sqrt{Z_o}\tan(\phi_-)\tan(\phi_+)}$$

$$Z_2 = Z_1$$

$$Z_3 = \frac{1}{2}Z_e\frac{2\sqrt{Z_e Z_o}\sin(2\phi_-) - j(Z_e - Z_o)\sin(2\phi_+)}{Z_e + Z_o + (Z_e - Z_o)\cos(2\phi_+)}$$

where $$\phi_+ = L_v(\beta_1 + \beta_2)/2$$

$$\phi_- = L_v(\beta_1 - \beta_2)/2$$

and Lv denotes the reduced length of the conductor lines.

The matching networks 19, 20, 21 are provided to transform port impedances Z1, Z2 and Z3 given above to the required input impedance (e.g. 50 Ohm). These matching networks 19, 20 and 21 are realized by distributed elements, e.g. metal lines coupled to the first and second metal line 15, 16 as shown in FIG. 1 or by lumped elements (like discrete capacitors on inductors). The miniaturization, which is achieved by this increases the commercial value of the design significantly. The lateral extension of the component is still larger than a discrete component. However, due to the small height (0.1 mm in the application example) and the in-plane configuration it is perfectly suitable for integration e.g. with LTCC technology.

The invention claimed is:

1. A non-reciprocal component comprising:

a first dielectric part positioned at a first level;

a ferrite substrate located at the first level;

a ground layer is located at a second level, below the ferrite substrate; and a metal line arrangement located on the first level, wherein the metal line arrangement comprises:

first and second metal lines arranged in parallel to each other on the ferrite substrate, the first metal line providing a first port and the second metal line providing a second port, wherein the first and second metal lines are connected to each other in a portion located on the first dielectric part and adjacent to the ferrite substrate;

a single third metal line coupled to the first and second metal lines at the portion located on the first dielectric part and adjacent to the ferrite substrate, the third metal line ending with a third port, wherein the ferrite substrate is magnetized in parallel to the metal lines; and first and second matching networks coupled to the first and second ports, respectively, the first and second matching networks being configured to force a wave to effectively pass the metal lines several times by multiple reflections.

2. A non-reciprocal component according to claim 1, further comprising a hard ferrite substrate arranged below the ground layer, the ferrite substrate located at the first level being magnetized by the hard ferrite substrate, the hard ferrite substrate being magnetized once with a field strength, wherein magnet poles of the hard ferrite substrate are located at first and second ends of the hard ferrite substrate, wherein magnetic field lines run in parallel to the metal lines on the ferrite substrate.

3. A non-reciprocal component according to claim 1, wherein the metal lines are strip lines, the non-reciprocal component further comprising:

a dielectric layer arranged above the strip lines; and an upper ground layer arranged above the dielectric layer.

4. A non-reciprocal component according to claim 1, wherein the metal lines are microstrip lines, the non-reciprocal component further comprising an air layer arranged above the microstrip lines.

5. A non-reciprocal component according to claim 1, wherein the first, second and third ports respectively have impedance values $Z_1$, $Z_2$ and $Z_3$ given by:

$$Z_1 = \sqrt{Z_o Z_o}\,\frac{\sqrt{Z_e}\tan(\phi_-) - j\sqrt{Z_o}\tan(\phi_+)}{\sqrt{Z_e} - j\sqrt{Z_o}\tan(\phi_-)\tan(\phi_+)}$$

$$Z_2 = Z_1$$

$$Z_3 = \frac{1}{2}Z_e\frac{2\sqrt{Z_e Z_o}\sin(2\phi_-) - j(Z_e - Z_o)\sin(2\phi_+)}{Z_e + Z_o + (Z_e - Z_o)\cos(2\phi_+)}$$

wherein the $\phi_+ = L_v(\beta_1+\beta_2)/2$ $\phi_- = L_v(\beta_1-\beta_2)/2$, $Z_e$ and $Z_o$ are characteristic impedances of two modes of the metal line arrangement, $\beta_1$ and $\beta_2$ are propagation constants of the two modes, and L, is a reduced length of the metal lines.

6. A non-reciprocal component according to claim 1, wherein the non-reciprocal component is configured to operate as a circulator.

7. A non-reciprocal component according to claim 1, wherein the first, second, and third ports have substantial equal impedances.

8. A non-reciprocal component according to claim 1, wherein the first and second metal lines each have a length that is less than a length equal to $\pi/2/|\beta\mathbf{1}-\beta\mathbf{2}|$, wherein $\beta\mathbf{1}$ and $\beta\mathbf{2}$ are propagation constants of first and second TEM modes of the metal lines.

9. A non-reciprocal component according to claim 1, comprising:

a second dielectric part, arranged at the first level, the ferrite substrate being located between the first dielectric part and the second dielectric part, wherein the first matching network and the second matching network being arranged on the second dielectric part, wherein the first matching network is a metal line connected to the first metal line and the second matching network is a metal line connected to the second metal line.

10. A non-reciprocal component according to claim 9, comprising a third matching network coupled to the third port and arranged on the first dielectric part, wherein the third matching network is a serial connection of metal lines having decreasing widths.

11. A non-reciprocal component according to claim 9, wherein at least one matching network includes discrete components arranged outside the first or second dielectric part.

12. An integrated circuit, comprising an integrated non-reciprocal component that includes:

a first dielectric part positioned at a first level;

a ferrite substrate located at the first level;

a ground layer is located at a second level, below the ferrite substrate; and a metal line arrangement located on the first level, wherein the metal line arrangement comprises:

first and second metal lines arranged in parallel to each other on the ferrite substrate, the first metal line providing a first port and the second metal line providing a second port, wherein the first and second metal lines are connected to each other in a portion located on the first dielectric part and adjacent to the ferrite substrate;

a single third metal line coupled to the first and second metal lines at the portion located on the first dielectric part and adjacent to the ferrite substrate, the third metal line ending with a third port, wherein the ferrite substrate is magnetized in parallel to the metal lines; and first and second matching networks coupled to the first and second ports, respectively, the first and second matching networks being configured to force a wave to effectively pass the metal lines several times by multiple reflections.

13. An integrated circuit according to claim 12, wherein the non-reciprocal component further includes a hard ferrite substrate arranged below the ground layer, the ferrite substrate located at the first level being magnetized by the hard ferrite substrate, wherein magnet poles of the hard ferrite substrate are located at first and second ends of the hard ferrite substrate, wherein magnetic field lines run in parallel to the metal lines on the ferrite substrate.

14. An integrated circuit according to claim 12, wherein the metal lines are strip lines, the non-reciprocal component further comprising:

a dielectric layer arranged above the strip lines; and an upper ground layer arranged above the dielectric layer.

15. An integrated circuit according to claim 12, wherein the metal lines are microstrip lines, the non-reciprocal component further comprising an air layer arranged above the microstrip lines.

16. An integrated circuit according to claim 12, wherein the first, second and third ports respectively have impedance values $Z_1$, $Z_2$ and $Z_3$ given by:

$$Z_1 = \sqrt{Z_o Z_o}\,\frac{\sqrt{Z_e}\tan(\phi_-) - j\sqrt{Z_o}\tan(\phi_+)}{\sqrt{Z_e} - j\sqrt{Z_o}\tan(\phi_-)\tan(\phi_+)}$$

-continued $$Z_2 = Z_1$$

$$Z_3 = \frac{1}{2}Z_e\frac{2\sqrt{Z_e Z_o}\sin(2\phi_-) - j(Z_e - Z_o)\sin(2\phi_+)}{Z_e + Z_o + (Z_e - Z_o)\cos(2\phi_+)}$$

wherein the $\phi_+ = L_v(\beta_1+\beta_2)/2$ $\phi_- = L_v(\beta_1-\beta_2)/2$, $Z_e$ and $Z_o$ are characteristic impedances of two modes of the metal line arrangement, $\beta_1$ and $\beta_2$ are propagation constants of the two modes, and L is a reduced length of the metal lines.

17. An integrated circuit according to claim 12, wherein the first, second, and third ports have substantial equal impedances.

18. An integrated circuit according to claim 12, wherein the first and second metal lines each have a length that is less than a length equal to $\pi/2/|\beta 1-\beta 2|$, wherein $\beta 1$ and $\beta 2$ are propagation constants of first and second TEM modes of the metal lines.

19. An integrated circuit according to claim 12, wherein:

the non-reciprocal component further includes a second dielectric part arranged at the first level;

the ferrite substrate is located between the first dielectric part and the second dielectric part;

the first matching network and the second matching network are arranged on the second dielectric part; the first matching network is a metal line connected to the first metal line; and the second matching network is a metal line connected to the second metal line.

20. An integrated circuit according to claim 19, wherein the non-reciprocal component further includes a third matching network coupled to the third port and arranged on the first dielectric part, wherein the third matching network is a serial connection of metal lines having decreasing widths.

* * * * *